US005941671A

United States Patent [19]

Wehrle

[11] Patent Number: 5,941,671

[45] Date of Patent: Aug. 24, 1999

[54] METHOD AND APPARATUS FOR MONITORING THE APPLICATION OF GLUE ONTO A BOOK BLOCK

[75] Inventor: Thomas Wehrle, Frauenfeld, Switzerland

[73] Assignee: Grapha-Holding, Hergiswil, Switzerland

[21] Appl. No.: 08/987,967

[22] Filed: Dec. 10, 1997

[30] Foreign Application Priority Data

Dec. 13, 1996 [CH] Switzerland ..... 3064/96

[51] Int. Cl.[6] ..... B42B 9/00; B42B 9/06

[52] U.S. Cl. ..... 412/8; 412/1; 412/11; 412/14; 73/150 R

[58] Field of Search ..... 412/1, 11, 14; 73/150 R

[56] References Cited

U.S. PATENT DOCUMENTS 3,937,453 2/1976 Hickey et al. .
4,782,331 11/1988 Martens .

FOREIGN PATENT DOCUMENTS 0275521 7/1988 European Pat. Off. .
3714226 11/1988 Germany .

*Primary Examiner*—Willmon Fridie, Jr.
*Assistant Examiner*—Mark T. Henderson
*Attorney, Agent, or Firm*—Friedrich Kueffner

[57] ABSTRACT

A method and apparatus for monitoring the application of glue onto the back of a book block processed in a book binding machine and bound by gluing, wherein the thickness of glue application is measured. At least the glue layer applied to the book block back travels partially through at least one measuring range formed by a ray bundle and directed transversely of the travel path of the book blocks. The apparatus includes a transmitter and corresponding receiver which together operate as a measurement transducer. The transducer forms a measuring range extending transversely of the travel path of a book block. The transmitter and receiver are arranged in the book binding machine and the book blocks are moved past the measuring range in such a way that at least the glue layer applied to the book block back partially extends into the measuring range.

16 Claims, 3 Drawing Sheets

METHOD AND APPARATUS FOR MONITORING THE APPLICATION OF GLUE ONTO A BOOK BLOCK

BACKGROUND OF THE INVENTION

1. Field of the Invention

The present invention relates to a method of monitoring the application of glue onto the back of a book block processed in a book binding machine and bound by gluing, wherein the thickness of glue application is measured.

2. Description of the Related Art

The application of glue onto book blocks in book binding machines has long been known in the art. The glue is applied on the book back as a layer by means of glue rollers. For the quality and durability of the printed products manufactured from the book blocks, it is essential that the glue is applied uniformly and everywhere with the optimum layer thickness. In the past, for controlling the glue application, the glued book blocks were visually checked and even cut open for this purpose. However, this is relatively cumbersome and smaller layer thickness differences or defects cannot be determined visually or can only be determined later.

In addition, reference is made to the book "Klebebinden" [adhesive binding] published by Beruf+Schule, Itzehoe, Germany.

SUMMARY OF THE INVENTION

Therefore, it is the primary object of the present invention to provide a method of the above-described type which makes possible a simpler and more reliable monitoring of the glue application.

In accordance with the present invention, at least the glue layer applied to the book block back travels partially through at least one measuring range formed by a ray bundle and directed transversely of the travel path of the book blocks.

The apparatus according to the present invention includes a transmitter and corresponding receiver which together operate as a measurement transducer. The transducer forms a measuring range extending transversely of the travel path of a book block. The transmitter and receiver are arranged in the book binding machine and the book blocks are moved past the measuring range in such a way that at least the glue layer applied to the book block back partially extends into the measuring range.

The transmission range of the measuring range covered by the book block back or the glue layer or the non-covered transmission range can be coupled back to a sensor and evaluated. The covered measuring range or transmission range is dependent on the glue thickness.

The apparatus according to the present invention makes possible an automatic and continuous monitoring of the glue application, so that deviations, for example, tolerance deviations, areas where no glue is applied or inclusions can be determined.

Since the transmitter and receiver are arranged laterally next to the travel path of the book blocks, a contamination of the apparatus is not possible.

The apparatus does not make it necessary to extend the length of the travel path because the transmitter and receiver can be accommodated without problems.

A measurement of the effective glue thickness is possible in a particularly exact manner if, in accordance with a further development of the invention, the transmitter and the receiver are arranged following the glue application and a second transmitter and receiver are arranged in front of the glue application. The first measurement takes place without any glue having been applied to the book block and the second measurement takes place after the glue has been applied to the book block. Both measuring arrangements or measurement transducers are preferably installed with the same mechanical and electrical conditions, so that equivalent electrical signals are available for comparison.

The difference between the two measuring signals can especially be used for measuring the effective glue layer or glue thickness. However, it is also possible to merely make a determination as to whether or not the glue application is located in a predetermined area.

A particularly precise measurement can be obtained if, in accordance with a further development of the invention, the apparatus includes a transmitter with a beam-shaped transmission window which is inclined transversely of the travel direction of the book back.

The beam-shaped transmission window can preferably be formed by a fiber optic cable which is beam-shaped in cross-section and has a high fiber density transversely of the conveying direction in accordance with the inclination.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
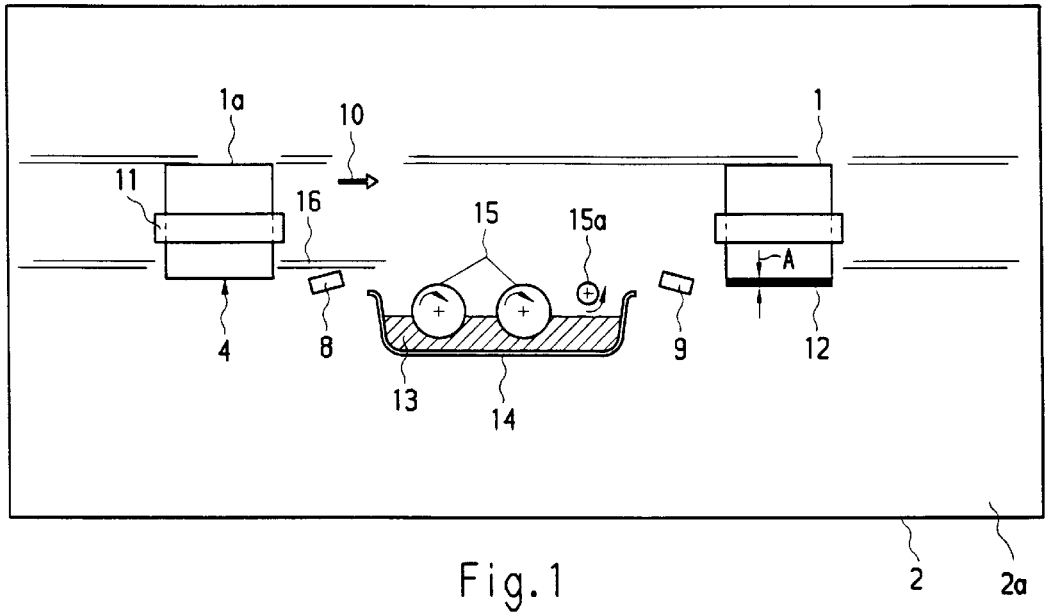
FIG. 1 is a schematic illustration showing the glue application onto a book block back in a book binding machine.

The book binding machine 2 partially illustrated in FIG. 1 of the drawing includes a stationary machine frame 2*a* which is only schematically illustrated. In the machine frame 2*a,* tongs 11 can be moved in the direction of arrow 10 on guide rails 16 successively in a row. The tongs 11 successively supply book blocks 1 to the various processing areas. Bound printed products are manufactured in the book binding machine 2 from printed sheets which previously have been loosely gathered into book blocks 1.

In the processing step illustrated in FIG. 1, a coat 12 of glue which has the purpose of holding the book block 1 together is applied to the book back 4 of the book block 1 which may be cut. In order to apply glue to the book block 1*a* on the left in FIG. 1 which has not yet been glued, the book block 1*a* is guided in the direction 10 over rollers 15 which with a lower portion thereof are immersed in glue 13 which is present in a glue basin 14. The two rollers 15 rotate in a clockwise direction, while a smaller roller 15*a,* called spinner in the art, rotates in the opposite direction and strips excess glue from the book back 4. During gluing, the book blocks 1 are continuously moved without interruption in the direction of the arrow 10.

A measuring device is provided for monitoring the application of glue. The measuring device includes two measurement transducers or arrangements 8 and 9 which are arranged at a distance from each other. The measuring arrangement 8 is located in front of the glue basin 14 as seen in the direction of movement 10 and the other measurement arrangement 9 is arranged following the glue basin 14. Both measurement arrangements 8 and 9 are preferably constructed equally and operate in accordance with the same principle.

Figure 2:
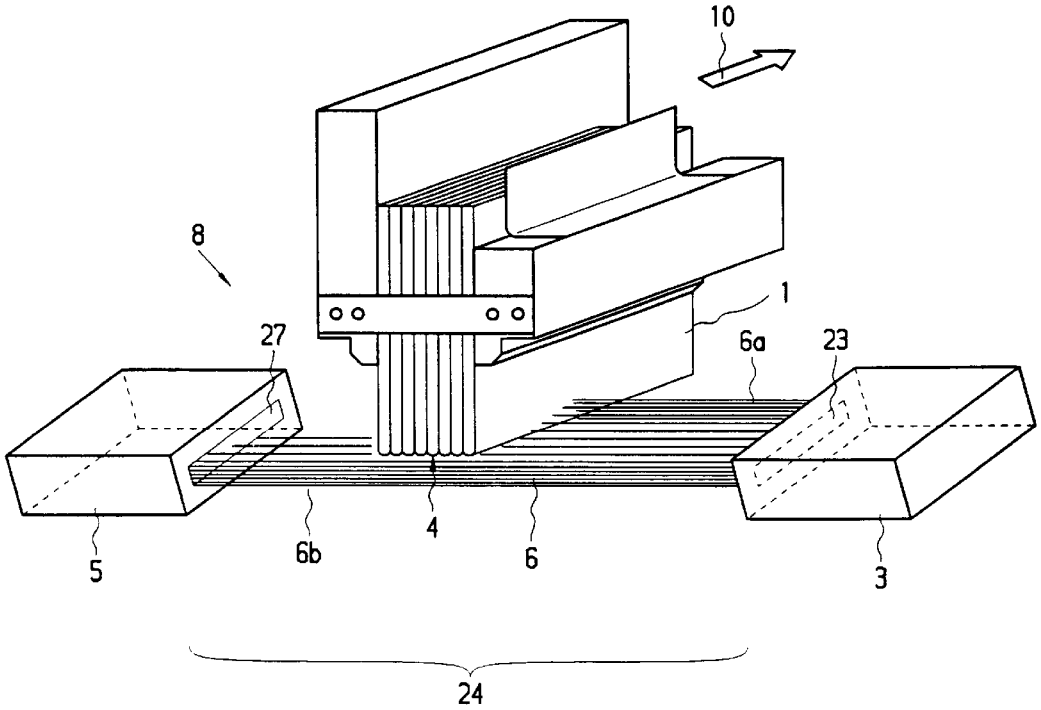
FIG. 2 is a schematic perspective view showing a portion of the apparatus according to the present invention.
Figure 3:
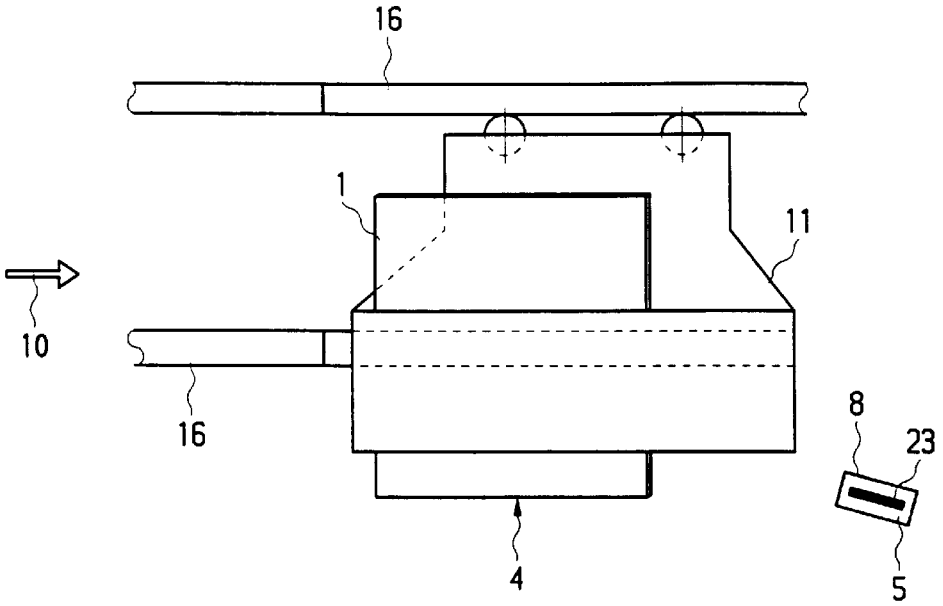
FIGS. 3 and 4 are additional partial views of the apparatus.
Figure 5:
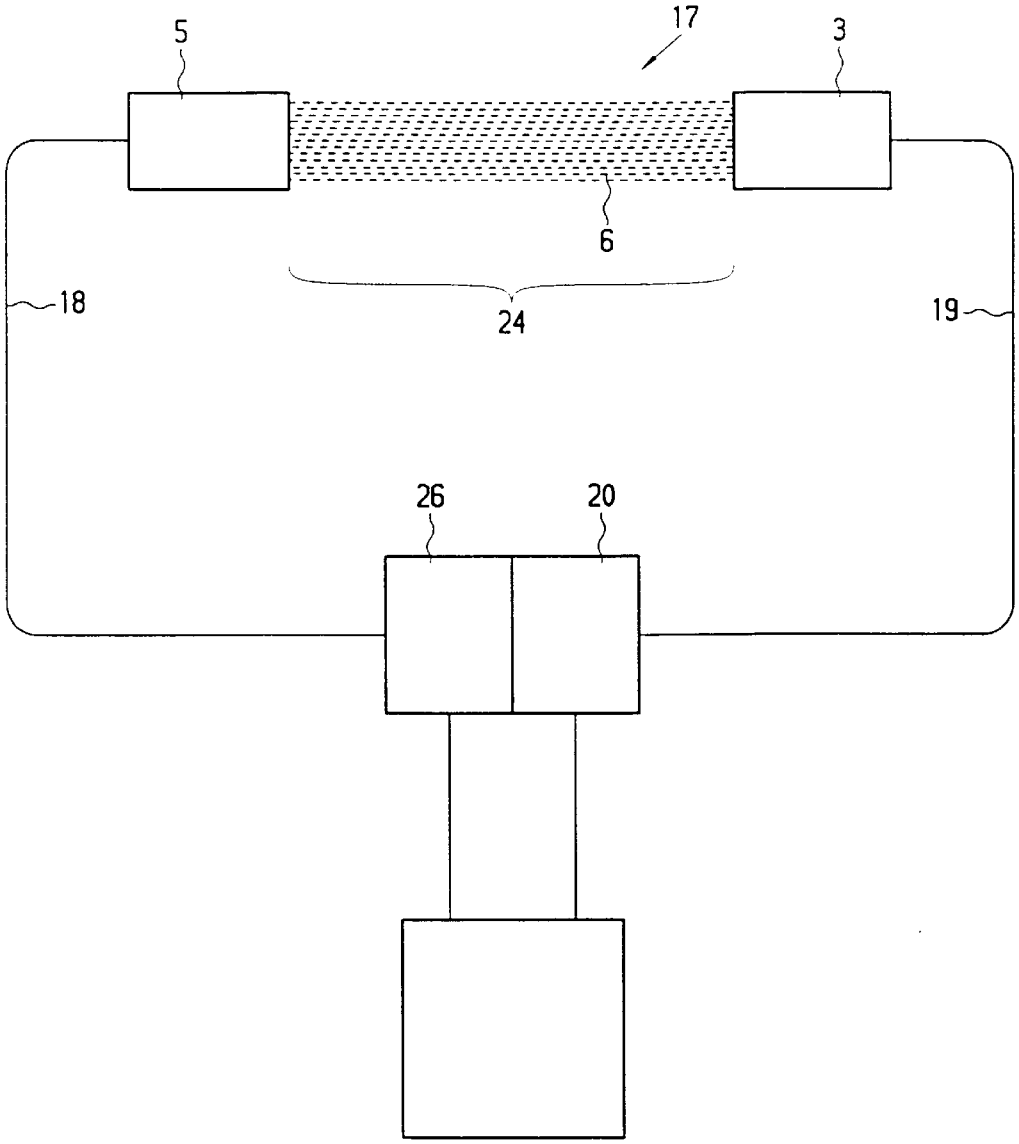
FIG. 5 is a schematic illustration of the apparatus according to the present invention.

Consequently, the measurement arrangement 8 shown in FIG. 2 corresponds to the measurement arrangement 9. The measurement arrangement 8 includes a transmitter 3 and a receiver 5, wherein an air gap 24 extending transversely of the direction of movement 10 exists between the transmitter 3 and the receiver 5. As illustrated in FIG. 5, the light (for example, infrared light) of a light source 20 is coupled in a fiber optic cable 19 or another suitable transmission medium. The light radiated by the transmitter 3 is received by the receiver 5 and is coupled back with a fiber optic cable 18 to a light-sensitive sensor element 26. The two fiber optic cables 18 and 19 as well as the transmitter 3 and the receiver 5 are preferably constructed identically. In addition, they preferably have a rectangular or beam-shaped cross-section, and the transmitter 3 as well as the receiver 5 each have a corresponding beam-shaped window 23 and 27, respectively. The measurement arrangement 8 operates in accordance with the one-way method, i.e., the receiver 5 formed by the fiber optic cable 18 is located at a defined distance relative to the transmitter 3. Consequently, the fiber optic cable 18 only serves as a transmission element for the received light and is mechanically coupled to the light sensor 26. The sensor 26 transforms the received light into an electrical signal which is used for further measuring purposes.

Figure 4:
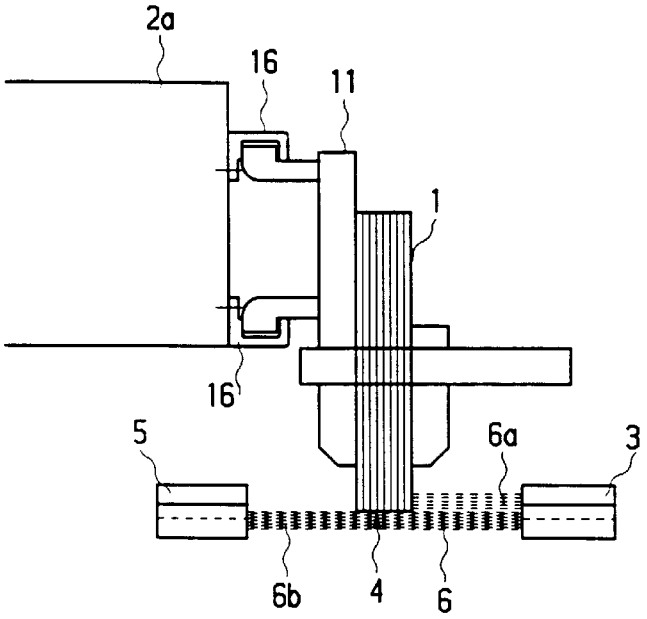
Figure 6:
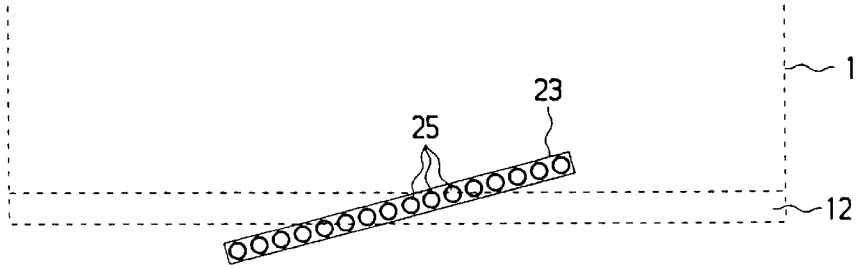
FIG. 6 is a schematic partial view of the apparatus according to the present invention.

As can be seen in FIG. 2 and especially in FIG. 6, the two windows 23 and 27 are aligned precisely parallel relative to each other and are inclined relative to the direction of movement 10. The gap 24 is arranged in such a way that the book back 4 individually travels through the beam-shaped light bundle 6 between the transmitter 3 and the receiver 5. As the book back 4 travels through the light bundle 6, a portion 6*a* of the light bundle 6 is covered by the book back 4 and this portion 6*a* does not reach the receiver 5, as clearly shown, for example, in FIG. 4. When the book back 1 travels through the light bundle 6, a lower portion 6*b* of the light bundle 6 is located underneath the book back to be glued and, thus, is received by the receiver 5. A portion 6*a* is also covered when the book back is not glued at the measured arrangement 8. However, in that case, the covered portion 6 is smaller than the portion covered at the measurement arrangement 9 because the layer 12 of glue applied to the book back now also covers a portion of the light bundle corresponding to the thickness of the layer. The windows 23 and 27 are arranged in such a way that the book backs cover, for example, about 50% of the light bundle. Consequently, the electrical signal of the sensor element 26 also corresponds to only 50% of the maximum value because, if a book block 1 is not present, the receiver 5 receives 100% of the light transmitted by the transmitter.

As already mentioned, the two measurement arrangements 8 and 9 are of equal construction. This means that the electrical signal of the measurement arrangement 8 and the electrical signal of the measurement arrangement 9 are equivalent and can be compared.

It is also essential to take into consideration that book blocks which have not been glued always produce the same signals in the measurement arrangement 8. On the other hand, the signals in the measurement arrangement 9 are dependent on the glue application and particularly on the layer thickness A, as shown in FIG. 1, of the glue layer 12. The difference between the two measurement signals can now be used for measuring the effective thickness of the glue. However, the difference of the signals can also be used for determining whether or not the glue application is within a predetermined defined range. Other applications are also conceivable. For example, it would be possible to graphically record a longitudinal profile of the glue layer 12.

Accordingly, the apparatus according to the present invention makes it possible to monitor any glue application on a book block 1. It is possible to immediately determine mistakes in the glue application, for example, caused by contamination, dust or glue threads or due to incorrectly mounting a book block 1, for example, in an inclined position.

The aforementioned inclination of the windows 23 and 27 facilitates a particularly precise measurement by means of fiber optic cables. As is apparent from FIG. 6, because of the inclination of the windows 23 and 27, more light fibers 25 are present in the range of the glue layer 12 than would be the case in a vertical arrangement. Of course, as a rule, substantially more light fibers 25 are actually present than are shown in FIG. 6. The transmission medium preferably is a temperature-resistant glass fiber cable, however, other transmission media are also conceivable.

The invention is not limited by the embodiments described above which are presented as examples only but can be modified in various ways within the scope of protection defined by the appended patent claims.

I claim:

1. A method of monitoring glue application onto a back of a book block processed in a book binding machine and bound by gluing, wherein monitoring is effected by measuring a thickness of a glue layer applied to the book back, the method comprising producing a measurement range composed of a ray bundle and extending transversely of a travel path of the book block, and moving at least the glue layer applied to the back of the book block at least partially through the measurement range.

2. The method according to claim 1, comprising producing the measurement range with a measurement transducer composed of transmitter and receiver arranged at the travel path of the book block, further comprising converting into a measurement signal a portion of the measurement range covered by the book block back with or without a glue layer or a portion of the measurement range not covered by the book block back, and utilizing the measurement signal for a comparison measurement.

3. The method according to claim 2, wherein the transmitter and the receiver are arranged on opposite sides of the travel path of the book block.

4. The method according to claim 2, wherein the transmitter and the receiver are arranged on one side of the travel path of the book block with a reflection effect being carried out between the transmitter and the receiver.

5. The method according to claim 2, wherein the glue is applied with a glue application thickness, further comprising comparing a difference value resulting from the comparison measurement to a desired value corresponding to the glue application thickness, and utilizing the result of the comparison for correcting the glue application.

6. The method according to claim 1, comprising arranging the measurement range downstream of a glue application means, and utilizing a book block back without glue as a reference value of the measurement range when measuring the glue application thickness.

7. The method according to claim 1, comprising arranging a measurement range upstream of a glue application means and a measurement range downstream of the glue application means, and connecting through a common reference value the measurement range for measuring the book block back without glue and the measurement range for measuring the glued book block back.

8. An apparatus for monitoring the application of glue onto a back of a book block processed in a book binding machine and bound by gluing, wherein monitoring is effected by measuring a thickness of a glue layer applied to the book block back, the apparatus comprising a measurement transducer mounted in the book binding machine, the measurement transducer comprising a transmitter and a receiver forming a measurement range therebetween, the measurement range extending transversely of a travel path of a book block, the measurement range being arranged such that at least the glue layer applied to the book block back at least partially covers the measurement range.

9. The apparatus according to claim 8, wherein the glue layer applied to the book block back has a thickness direction with a free glue edge, the measurement range being arranged so as to project beyond the glue layer in the thickness direction at least at the free glue edge.

10. The apparatus according to claim 8, comprising a glue application station, the measurement range being located downstream of the glue application station.

11. The apparatus according to claim 10, wherein the transmitter comprises a beam-shaped transmission window, wherein the transmission window is arranged transversely of and inclined relative to the travel path of the book block.

12. The apparatus according to claim 11, comprising an additional measurement transducer arranged upstream of the glue application station.

13. The apparatus according to claim 12, wherein the measurement transducers are configured to produce equivalent signals, and wherein the receivers of the measurement transducers are connected to a comparing device for evaluating the signals in a computer.

14. The apparatus according to claim 13, comprising control means for jointly controlling the computer and the glue application station of the book binding machine.

15. The apparatus according to claim 13, comprising a control circuit connecting the glue application station and the computer.

16. The apparatus according to claim 8, wherein the transmitter is connected to a light source and the receiver is connected to a sensor.

* * * * *